United States Patent [19]

Sanfilippo

[11] Patent Number: 4,827,827

[45] Date of Patent: May 9, 1989

[54] MULTIPLE CARTRIDGE FILLING DEVICE HAVING A PLURALITY OF MEASURING CAVITIES

[76] Inventor: Philip M. Sanfilippo, 225 Franklin Rd., Apt. 45-B, Atlanta, Ga. 30342

[21] Appl. No.: 191,243

[22] Filed: May 6, 1988

[51] Int. Cl.[4] ..... F42B 33/02; F42B 3/20; F42D 1/08

[52] U.S. Cl. ..... 86/33; 86/20.13; 86/29; 86/31; 86/21; 222/460; 222/572

[58] Field of Search ..... 86/20.1, 20.13, 20.14, 86/21, 23, 24, 25, 29, 30, 31, 33; 222/636, 442, 444, 460, 462, 478, 572; 102/430, 448, 449

[56] References Cited

U.S. PATENT DOCUMENTS

| | | | |
|---|---|---|---|
| 56,489 | 7/1866 | Dodge et al. | 86/31 |
| 207,853 | 9/1878 | Dalzell | 86/31 |
| 235,699 | 12/1880 | Osgood | 86/31 |
| 301,003 | 6/1884 | Poole | 86/31 |
| 302,207 | 7/1884 | Lockett | 86/31 |
| 506,425 | 10/1893 | Elliott | 86/31 |
| 1,604,145 | 10/1926 | Candee | 86/31 |

*Primary Examiner*—Howard J. Locker

[57] ABSTRACT

Multiple measuring cavities of given and identical volume are formed in a base. Each measuring cavity is elevated from the base by a protrusion with tapered sides. Pulverulent or granular material is then poured into the cavities filling them to overflowing. The excess material flows down the protrusions and drains through holes in the base. The surfaces of the base present sharp edges to the flow of medium to eliminate its collection other than in each measuring cavity. Cartridges to be filled are inverted and the cartridge mouth is placed over each protrusion and its full measuring cavity. The cartridge mouths come to rest on the tapered sides of each protrusion. A cartridge retaining cover made to fit over and align with the base is placed over the cartridges. The cover holds the cartridges is contact with the sides of the protrusions, then, the cover and base are grasped and turned over as a unit, emptying the contents of the measuring cavities into the cartridges. The base us then lifted from the now upright and filled cartridges leaving them ready for subsequent operations.

4 Claims, 2 Drawing Sheets

MULTIPLE CARTRIDGE FILLING DEVICE HAVING A PLURALITY OF MEASURING CAVITIES

REFERENCES CITED

| U.S. PATENT DOCUMENTS | | | |
|---|---|---|---|
| 235,699 | 5/1880 | Osgood | 86/31 |
| 506,425 | 4/1893 | Elliott | 86/31 |
| 747,422 | 12/1902 | Helm | 86/31 |
| 4,418,606 | 4/1983 | Lee | 86/31 |

This relates to a powder and shot measure and cartridge filling device for the accurate, rapid and safe charging of cartridge cases in the process of making ammunition. It speeds the measuring of multiple charges and allows the filling of many cartridges simultaneously. It eliminates the possibility of putting more than one charge in each cartridge making it safer than any measure in use currently.

BACKGROUND OF THE INVENTION

The economy of reloading used cartridges has long been known to participants in the shooting sports. Hand loaders have sought out and used reloading equipment for over a hundred years. The equipment whose commercial success has endured is inexpensive, reliable and safe.

The basic process of reloading ammunition consists of six operations; (1) punching out the spent primer; (2) swaging the cartridge to its unfired diameter with a die; (3) pressing in a new primer; (4) measuring a volume of powder and pouring it into the cartridge; (5) pressing a bullet into the cartridge mouth (or adding a measure of shot for shot shells). The equipment for performing these operations varies from simple hand tools to complex high speed commercial reloading machinery.

The area of invention addressed here is in the operation of measuring volumes of powder or shot and introducing them into cartridges. The requirements of the operation are an accurate measure of powder or shot and the ability to introduce it into the cartridge without spillage. Commercial reloading equipment meters a consistent charge by volume. Volumetric measuring works well and is in general use by reloaders because the alternative method of weighing every charge is too time consuming.

Consistent charges in each cartridge contribute to the accuracy of the ammunition. Overcharges in ammunition can be dangerous and cause excessive pressures in cartridges and firearms endangering the shooter.

To determine the appropriate charge, reloaders refer to data published by ammunition component manufacturers. A safe weight of powder or shot is specified for each combination of bullet or shot weight, powder, and expected velocity for each type of ammunition. Suppliers of volumetric powder measures provide data to convert weights of various brands and types of powder to equivalent volumetric measuring chambers and powder spoons. These means are then used to meter a consistent volume of powder and deposit it into the cartridge mouth. One cartridge is charged at a time. Care must be taken to avoid introducing more than one powder charge in each cartridge, since it is possible to do so with these devices. Charges of shot are handled in a similar manner, converting weight to volume.

In the search for reducing hand loading labor a multiple cartridge loading device, U.S. Pat. No. 506,425 dates from 1893. It consisted of a box fitted with sliding panels. The cartridges were placed in the bottom, mouth up, beneath spillways. A sliding solid panel was then slid in on top of the spillways followed by panels of varying thickness, and holes aligning with each other and the spillways. The desired charge volume was reached by choosing the right combination of panels with holes and sliding them over the solid panel. The powder or shot was poured over the holes filling them and the excess was raked off with a straight edge. Sliding out the bottom solid panel allowed the contents of the holes to flow into the cartridges below. The commercial success of this device is doubtful since it is not in common use today.

OBJECTS AND FEATURES OF THE PRESENT INVENTION

The objectives of the present invention are to provide more safety and facility to the hand reloading of ammunition than has been previously possible. The invention performs the operation of charging multiple cartridges with identical volumes of powder or shot simultaneously. The possibility of double charging a cartridge is eliminated by the invention.

To achieve these objectives the invention provides a stable freestanding base with multiple measuring cavities of identical volume equivalent to useful weights of powder or shot for the ammunition being loaded. The measuring cavities are elevated by being formed in the tops of protrusions. The protrusions are wider at the bottom and taper to the lip of the measuring cavity at the top. Holes in the base are interspersed with the protrusions for draining excess powder or shot from the base. All surfaces of the base other than the measuring cavities present sloping surfaces and sharp edges to the flow of powder or shot to prevent it from collecting on the base other than in the measuring cavities.

Also provided is a cartridge retaining cover whose flat surface spans the measuring cavities. The undersurface texture of the cover is resilient to provide even pressure in holding cartridges to be filled against the sides of the protrusions.

In use, powder or shot is poured into each measuring cavity until each is full to overflowing. This is done rapidly without undue regard for the overflow from each cavity. The base may be placed in a shallow vessel to catch any overflowing powder or shot for reuse. Once all the measuring cavities are filled to overflowing they may be struck level with a suitable straight edge. Then cartridges of like size, to be charged, are turned open mouth down and placed on the protrusions. This necessary inversion insures safety since if the cartridges have been previously charged, the charge will be emptied out. Their rims rest on the sides of the protrusions and the full measuring cavities are inside them. The sloping sides of the protrusions hold the cartridges upright in the inverted position while plugging the cartridge mouths. The sloping sides of the protrusions allow a range of cartridge types to be charged. Larger diameter cartridges will come to rest further down on the protrusions, smaller cartridges, further up. With all the measuring cavities and protrusions covered by an inverted cartridge the cartridge retaining cover is then employed. The cartridge retaining cover is placed over the cartridge bottoms, resilient side down. Aligning struts and receptacles in the base and cover respectively provide lateral stability between the two. Opposing handles on the cover and base provide ease in picking up the cover and base with one hand on each side and turning them over as a unit. Powder or shot in the base measuring cavities is deposited in the cartridges by the force of gravity. The base now on top may be taped lightly to insure all of the charge is released into the cartridges. The base is then removed leaving the charged cartridges standing upright on the retaining cover ready for subsequent operations in the loading process.

The present invention is suitable for charging shot shell cartridges with shot as well as powder since wads are normally used in this type of ammunition over the powder charge. The powder charge is thus retained in the cartridge when inverted for filling with shot.

BRIEF DESCRIPTION OF THE DRAWINGS

The several objectives and features of the invention are more readily apparent from the following brief description taken in conjunction with the accompanying drawings in which.

DETAILED DESCRIPTION OF THE DRAWINGS

Figure 1:
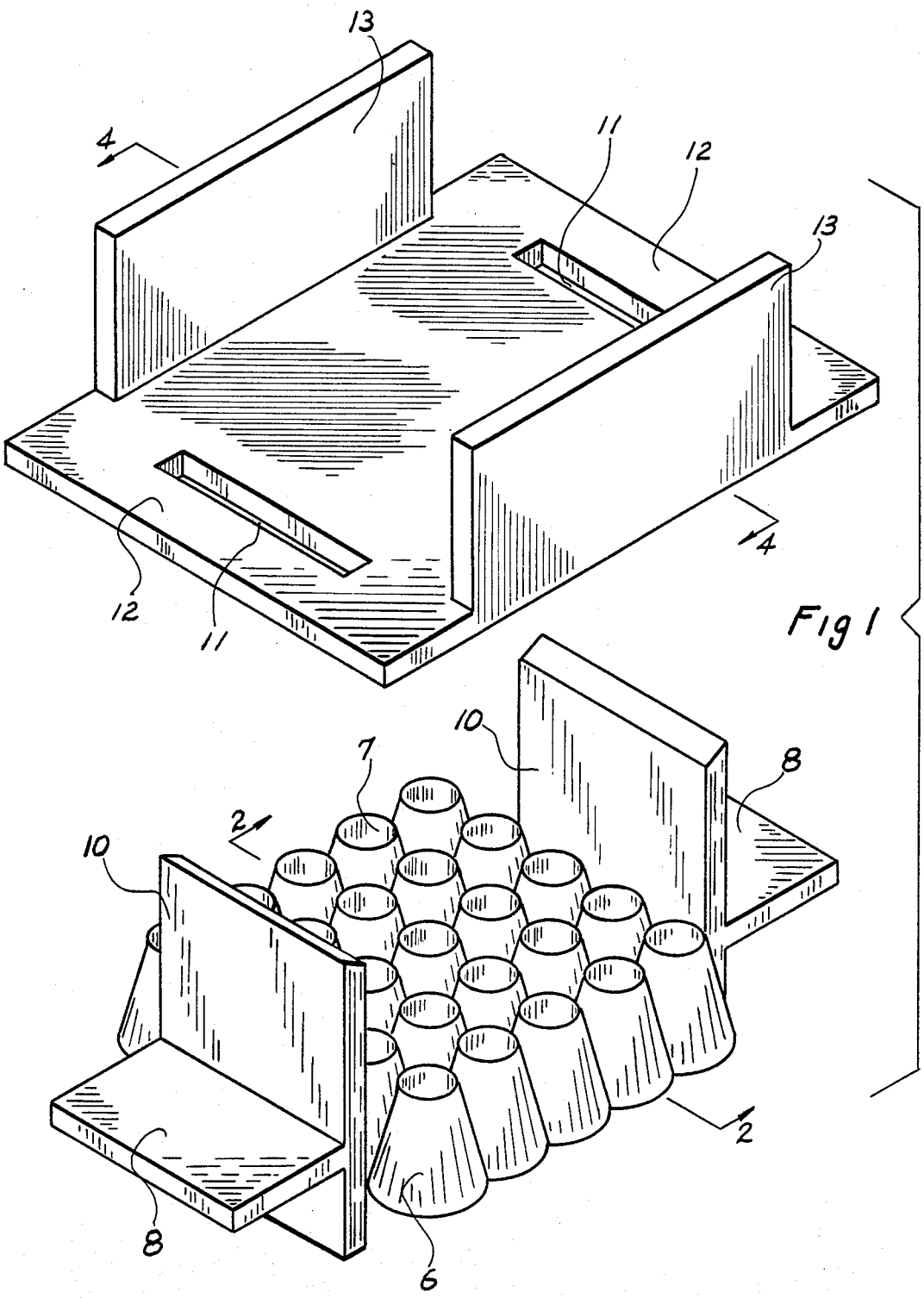
FIG. 1 is a perspective view of the preferred embodiment of the invention illustrating the base with upwardly projecting multiple protrusions and above, the cartridge retaining cover in perspective alignment with the base.

The base is illustrated in the lower perspective view of FIG. 1 and the cartridge retaining cover is illustrated in the upper perspective view of FIG. 1.

The base is formed or fabricated from suitable material such that it is a rigid, stable and freestanding platform. The base consists of multiple protrusions 6 of circular cross section, tapering as they project upward. Within each protrusion is a measuring cavity 7 of equal and useful volume for the selected cartridge charging medium. The base also consists of struts 10 at each end whose top portion is an alignment device and whose lower portion elevates and stabilizes the multiple protrusions when placed on a plane surface. Affixed to each strut 10 are handles 8 for grasping the base.

The cartridge retaining cover shown in the upper perspective view of FIG. 1 is sized to span the length and width of said base. Incorporated in the cover are handles 12 at each end for grasping the cover. Slots 11 in the cover receive said base alignment struts 10. Flanges 13 are also incorporated as part of the cover to provide stability and elevation when the cover is inverted and placed on a plane surface.

Figure 2:
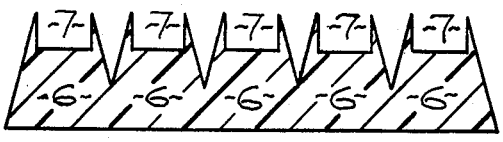
FIG. 2 is a sectional view of the base embodiment shown in FIG. 1 taken along line 2—2 of FIG. 1 looking in the direction of the arrows, illustrating the base protrusions with measuring cavities.

FIG. 2 is a sectional view of the base embodiment shown in FIG. 1 taken along line 2—2 of FIG. 1 looking in the direction of the arrows. FIG. 2 illustrates the measuring cavities 7 in said base protrusions 6. Cartridge filling medium is deposited in each cavity 7 until overflowing to insure a consistent volume measurement.

Figure 3:
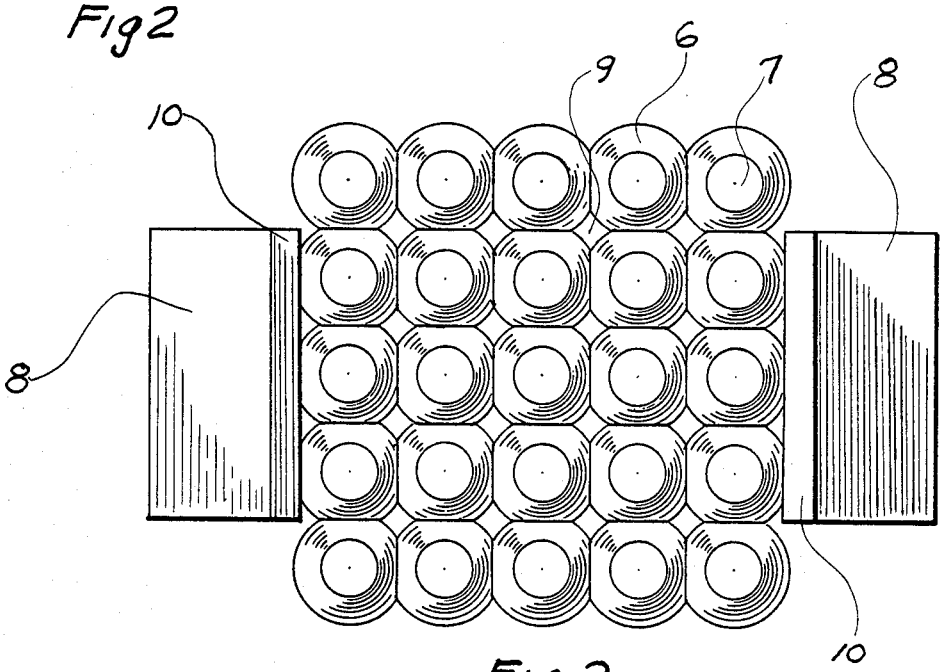
FIG. 3 is a plan view of the top of the base illustrating the protrusions with measuring cavities interspersed with drain holes in the valleys for the passage of overflow filler material.

FIG. 3 is a plan view of the top of the base illustrating drain holes 9 interspersed with protrusions 6 with measuring cavities 7 contained therein. Also shown are handles 8 and alignment struts 10 at each end. The drain holes 9 carry overflow filler material away from said protrusions and clear of the base for containment and reuse.

Figure 4:
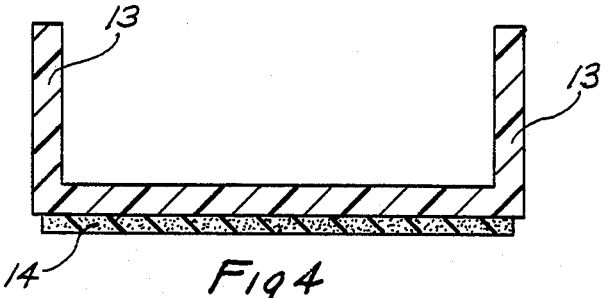
FIG. 4 is a sectional view of the embodiment shown in FIG. 1 taken along line 4—4 looking in the direction of the arrows, illustrating the cartridge retaining cover, the resilient material affixed to the cover and the supporting flanges formed in the cover.

FIG. 4 is a sectional view of the cartridge retaining cover shown in FIG. 1 taken along line 4—4 of FIG. 1 looking in the direction of the arrows. FIG. 4 illustrates the resilient material 14 affixed to and spanning the bottom surface of the cover more or less in its entirety. Also illustrated are flanges 13 on each side which provide stability when the cover is inverted and placed on a plane surface.

Figure 5:
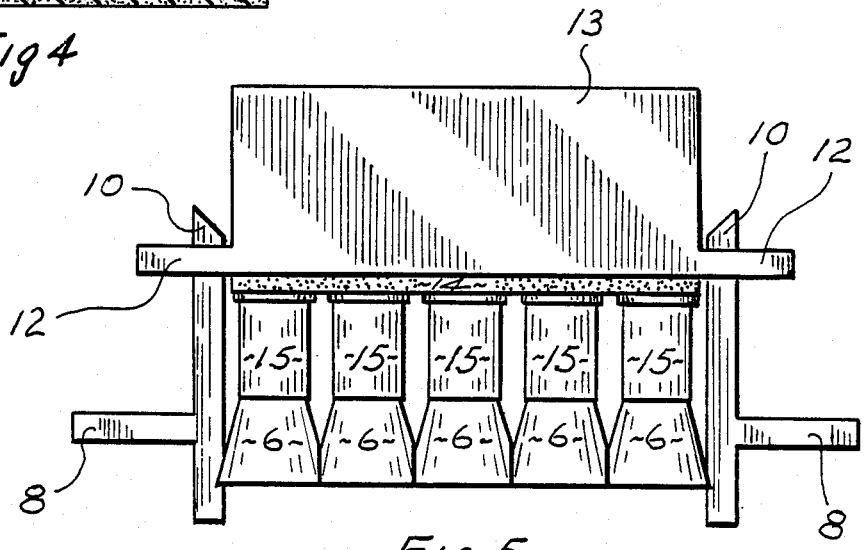
FIG. 5 is an elevation view of the side of the embodiment shown in FIG. 1 illustrating inverted cartridges in place on the base protrusions. Said cartridges are held in place by the cartridge retaining cover which is aligned and fixed laterally by struts projecting from the base and through openings in the cartridge retaining cover. Also illustrated are opposing handles on base and cover for grasping and inverting the base and cover as a unit.

FIG. 5 is an elevation view of the side of the invention illustrating the assembly of components necessary in its use. The base and cartridge retaining cover are as embodied in FIG. 1. The powder or shot measuring and cartridge filling operation commences with said base in the orientation shown, protrusions 6 and measuring cavities upward. Powder or shot to be measured is deposited in each measuring cavity by pouring from a suitable vessel in a rapid manner insuring only that all cavities are full to over flowing. Overflowing each cavity is sufficient to insure consistent volumetric measures; however, the measuring cavities may be struck level with a suitable straight edge. Overflowing material is drained from the base by holds in each of the valleys between protrusions. The base surfaces except the measuring cavities are sharp to the flow of powder or shot and present sloping surfaces to drain it from the base and into a suitable catch vessel for reuse. Cartridges 15 to be filled are inverted and placed on the protrusions 6 whose size and taper are such that the cartridge mouths fit over the protrusions 6 and their full measuring cavities, coming to rest on the tapered sides of the protrusions 6. When all protrusions 6 have an inverted cartridge 15 on them in a more or less vertical orientation the cartridge retaining cover is placed over the cartidges 15 and is oriented by the base alignment struts 10 which fit through slots in the cartridge retaining cover. The bottom surface of the cover 14 in contact with the inverted cartridge 15 is a resilient material, which provides for a more or less even force on each cartridge 15, holding its mouth in contact with the sides of said protrusions 6. The base and cartridge retaining cover are held together sandwiching the cartridges between them by grasping the base handles 8 and the cover handles 12 each between the thumb and fingers. The cartridge filling process is now executed by turning the assembly of FIG. 5 over so that it becomes to rest on the cover flanges 13. The powder or shot charges measured in the cavities of the base are deposited in each cartridge by gravitational force. To insure complete release of all measured medium, the base may be tapped lightly. The base now on top of the cartridges 15 is removed leaving the charged cartridges in an upright position ready for subsequent operations.

I claim:

1. In a combined powder and shot measure and cartridge filling device the improvements which comprise:

(a) means to accumulate measures of filler material from a flowing stream thereof wherein excess filler material is eliminated, said means consisting of measuring cavities having vertical openings, exterior conical surfaces small ends up terminating at the upper extreme of said vertical openings and interconnections at the large end, the exterior conical surfaces of said cavities being of sufficient taper to urge excess filler material to flow down said surfaces, and drain holes interspersed around the large interconnected ends of said measuring cavities such that excess filler material flows through said drain holes exiting the exterior conical surfaces of said interconnected measuring cavities thereby allowing filler material to accumulate exclusively within said measuring cavities;

(b) means to retain a plurality of cartridges irrespective of their mouth diameter and independent of their exterior shape in an essentially mouth down orientation, said means consisting of measuring cavities having exterior conical surfaces small ends up and of sufficient height and taper to allow cartridge mouth rims to fit over each of said measuring cavities coming to rest on said exterior conical surfaces with axes essentially aligned with said measuring cavities and at an elevation fixed by the cartridge mouth diameter, retention being effected by the weight of each cartridge bearing against the exterior conical surface of a corresponding measuring cavity at the circular mouth rim of said cartridge;

(c) means to fill a plurality of cartridges irrespective of their length and independent of their exterior shape wherein said plurality of cartridges is essentially uniform for a given filling operation, said means consisting of a cartridge retaining cover acting in conjunction with measuring cavities having exterior conical surfaces small ends up and interconnected at their large end, said cartridge retaining cover having an essentially rigid flat surface which rests on the closed ends of cartridges retained in a mouth down orientation by said measuring cavities whereupon a diametrical clamping force applied to cartridges through said cartridge retaining cover and measuring cavities holds cartridges in continuous contact with said cartridge retaining cover and in engagement with said measuring cavities enabling said cartridge retaining cover, cartridges, and measuring cavities to be turned upside down as a unit expelling filler material from said measuring cavities and depositing it into said cartridges.

2. In a combined powder and shot measure and cartridge filling device as recited in claim 1 further comprising means to isolate the transfer of filler material between measuring cavities and cartridges, said means consisting of interconnected measuring cavities having exterior conical surfaces which fit into and seal cartridge mouths and an essentially rigid cartridge retaining cover which rests on the closed ends of cartridges so engaged, said cartridges being held by a diametrical clamping force applied to said cartridges through said measuring cavities and cartridge retaining cover wherein filler material flows from said measuring cavities into said cartridges when said cartridge retaining cover, cartridges, and measuring cavities are turned upside down as a unit.

3. In a combined powder and shot measure the cartridge filling device as recited in claim 1 further comprising means to restrict the filling function to cartridges void of loose material, said means consisting of interconnected measuring cavities having exterior conical surfaces which act to hold and fill cartridges when said cartridges are inverted open mouth down and placed over said measuring cavities, the necessary inversion of cartridges acting to expell loose material contained therein.

4. In a combined powder and shot measure and cartridge filling device as recited in claim 1 further comprising means to measure filler material and fill cartridges with a device comprised of two separate components each made of continuous suitable material, said means consisting of a plurality of interconnected measuring cavities having exterior conical surfaces small end up and a cartridge retaining cover having an essentially rigid flat surface.

* * * * *